US009194137B2

(12) United States Patent
Williams

(10) Patent No.: US 9,194,137 B2
(45) Date of Patent: Nov. 24, 2015

(54) TRIM MOLDING SYSTEM AND METHOD

(71) Applicants: Terry Williams, Saskatoon (CA); Sheldon Goodheart, Kindersley, CA (US)

(72) Inventor: Terry Williams, Saskatoon (CA)

(73) Assignee: Sheldon Goodheart, Saskatchewan (CA)

( * ) Notice: Subject to any disclaimer, the term of this patent is extended or adjusted under 35 U.S.C. 154(b) by 0 days.

(21) Appl. No.: 14/477,138

(22) Filed: Sep. 4, 2014

(65) Prior Publication Data

US 2015/0143771 A1 May 28, 2015

(30) Foreign Application Priority Data

Nov. 28, 2013 (CA) ..... 2832135

(51) Int. Cl.
*E04F 19/04* (2006.01)

(52) U.S. Cl.
CPC ..... *E04F 19/0463* (2013.01); *E04F 19/0477* (2013.01); *E04F 2019/0454* (2013.01)

(58) Field of Classification Search
CPC ... E04F 13/06; E04F 19/0436; E04F 19/0495; E04F 19/02; E04C 2/38; F16B 5/123; F16B 5/125; F16B 5/128; F16B 21/09; F16B 5/07; F16B 5/0642; F16B 5/0664; F16B 5/0657; F16B 5/0635
USPC ..... 52/287.1, 288.1, 204.3, 211–213, 52/745.21, 717.01, 716.1, 716.4, 716.6, 52/716.7, 716.8, 718.03, 718.04, 718.06, 5
See application file for complete search history.

(56) References Cited

U.S. PATENT DOCUMENTS

| | | | | | |
|---|---|---|---|---|---|
| 2,927,339 | A * | 3/1960 | Grunwald | 16/16 |
| 3,422,584 | A * | 1/1969 | Howard | 52/98 |
| 3,609,928 | A * | 10/1971 | Mock | 52/210 |
| 3,777,438 | A * | 12/1973 | Brown | 52/718.04 |
| 4,642,957 | A * | 2/1987 | Edwards | 52/242 |
| 5,149,569 | A * | 9/1992 | McCue | 428/31 |
| 5,222,343 | A * | 6/1993 | Anderson | 52/718.04 |
| 5,292,013 | A * | 3/1994 | Earl | 248/73 |
| 5,353,571 | A * | 10/1994 | Berdan et al. | 52/716.5 |
| 5,463,835 | A * | 11/1995 | Wood | 52/288.1 |
| 5,553,946 | A * | 9/1996 | Agari | 384/49 |
| 5,694,726 | A * | 12/1997 | Wu | 52/287.1 |
| 5,743,064 | A * | 4/1998 | Bennett | 52/718.04 |
| 5,979,132 | A * | 11/1999 | Margarit | 52/312 |
| 6,148,584 | A * | 11/2000 | Wilson | 52/717.01 |
| 6,287,046 | B1 * | 9/2001 | Neuhofer, Jr. | 403/382 |
| 6,474,038 | B2 * | 11/2002 | Nien et al. | 52/717.01 |
| 6,604,331 | B1 * | 8/2003 | Pallas et al. | 52/287.1 |
| 6,729,087 | B2 * | 5/2004 | Sauter | 52/290 |
| 8,171,698 | B2 * | 5/2012 | Neuhofer jun. | 52/718.06 |
| 2002/0178684 | A1 * | 12/2002 | Barnett | 52/716.1 |
| 2008/0202049 | A1 * | 8/2008 | Galas | 52/288.1 |
| 2012/0145662 | A1 * | 6/2012 | Geng | 211/175 |
| 2012/0272610 | A1 * | 11/2012 | Bottorff et al. | 52/718.02 |
| 2013/0276406 | A1 * | 10/2013 | Coate | 52/745.21 |

* cited by examiner

*Primary Examiner* — Beth Stephan
(74) *Attorney, Agent, or Firm* — Trego, Hines & Ladenheim, PLLC

(57) ABSTRACT

An improved trim molding system for use in construction comprises a molding base and a complementary pre-fabricated molding face. The base is easily installed on the surface of a location where a molding is desired. The molding face fits onto the base and is secured to the base by an adhesive material. The two-component system provides for secure fit and an aesthetically pleasing finished product.

4 Claims, 2 Drawing Sheets

TRIM MOLDING SYSTEM AND METHOD

The present invention is in the field of building products, and in particular systems and methods of installing trim moldings.

BACKGROUND OF THE INVENTION

Finishing trim products have been widely used in the construction industry. These products are designed so that imperfections in the fit of building components can be covered in order to produce a more aesthetically pleasing finished product. Trims provide an advantage in that rather than having to have all components of a building (e.g., drywall, window frames, etc.) fit perfectly, these component can be roughly finished, saving time in construction and as a result, the cost of the finished building.

In the past, most prior art finishing elements such as baseboards, window casings and the like have been secured to a building by simple fastening methods such as nails, screws tacks, glues and other fastening. The disadvantage of these prior art products is that the fasteners mar the surface of the trim piece, requiring that they be filled, and or/painted in order to make the fastener less obvious to the eye. A further disadvantage is that over time the fill and/or paint can degrade, such that the fastener is now seen again, requiring ongoing maintenance to keep up the look of the finishing trim piece. In simple trim systems, where the trim piece is glued to a surface, there is an additional disadvantage in that as the glue degrades over time, the trim piece may come loose, there being nothing else to keep it in place, and the finishing trim can simply fall away from the surface to which it was originally installed.

Another disadvantage of prior art systems is that simply nailing a piece of trim to a wall or window casing, for example, does not guarantee a quality fit. It is well-known that in order to save time and costs, builder frequently pay little attention to details of finishing and as a result, baseboards and window casings, as well as other finishing elements, may not be particularly carefully installed, with the result that the overall appearance of the construction is diminished. Such free hand installation systems suffer from the inability to easily align the trim piece for optimal look and fit.

A variety of solutions have been attempted to improve the art of finishing trims. For example, U.S. Pat. No. 4,463,539 (Simon) describes a channel adapted to receive a molding piece. U.S. Pat. No. 5,179,811 (Walker) describes a system to install crown moldings at the junction between a wall and ceiling in a room. Similarly, U.S. Pat. No. 5,233,804 (Miller) describes a corner protector device that comprises a clip attached to the corner of a wall, and an overlying protector that engages the clip.

U.S. Pat. No. 6,148,584 (Wilson) describes a plastic attachment strip onto in which a spline engages part of the trim piece. However, this particular solution is awkward to use as it requires the trim to be applied in two separate pieces onto the attachment system, increasing the difficulty of installation and likelihood that parts will not be well-aligned in the finished product. A modified version of the installation system described in the '584 patent uses two attachment clips, for example, one on the facing trim, and a second on the door jamb portion, as described in U.S. Pat. No. 6,560,944 (Wilson). This solution is in fact more complicated than the earlier system described in the '584 patent as it now requires two attachment clips to be installed.

U.S. Pat. No. 7,748,179 (Schiedeggar et al.) describes a decorative molding that fits over a mantelpiece mounted on a structure. However, this system requires multiple components, including end covers, in order to complete the finished appearance.

Thus, because of the limitations in the prior art approaches to finishing trims, what is needed is a simple system that permits the snapping into place of a completely finished trim piece such that the trim piece is not marred by fasteners, and which is readily adaptable to a range of installation locations.

SUMMARY OF THE INVENTION

It is an object of the present disclosure to provide a finishing trim system that improves on prior art designs. In the present invention, the combination of traditional fasteners such as screws or nails is used to install a base portion to the location where trim is desired. A prefinished molding face portion is installed onto the molding base. The face portion is secured both by adhesive, and by complementary surfaces, such as tongue and groove, or cove and bead combinations that maintain the position of the face portion on the base portion. The present design avoids the need for fasteners that might otherwise mar the appearance of the finished face.

Thus, in some embodiments, the invention comprises a finishing trim system, comprising: a base portion, comprising an inner surface, outer surface and side surfaces, wherein the inner surface of the base portion is configured to be secured to a building structure; a trim portion, comprising an inner surface, outer surface, inner side surfaces and outer side surfaces, wherein the outer surface and outer side surfaces comprise a substantially finished ornamental configuration; wherein the base portion outer surface and side surfaces are configured receive the trim portion inner surface and inner side surfaces respectively, installable on the base portion; and wherein when the trim portion is installed on the base portion, the base portion is substantially concealed by the trim portion.

In some embodiments, the base portion further comprises a structure adapted to grip a corresponding structure on the trim portion. In some embodiments, the structure adapted to grip comprises a bead, and the corresponding structure on the trim portion comprises a groove. In some embodiments, the structure adapted to grip comprises a ball, and the corresponding structure on the trim portion comprises a detent.

In some embodiments, the at least one of the base portion and trim portion comprises an adhesive configured to secure the trim portion to the base portion.

There is also provided a method of installing a finishing trim, the method comprising: providing a base portion, comprising an inner surface, outer surface and side surfaces, wherein the inner surface of the base portion is configured to be secured to a building structure; providing a trim portion, comprising an inner surface, outer surface, inner side surfaces and outer side surfaces, wherein the outer surface and outer side surfaces comprise a substantially finished ornamental configuration; wherein the base portion outer surface and side surfaces are configured receive the trim portion inner surface and inner side surfaces respectively, installable on the base portion; and securing the base portion to a location on a structure where a finishing trim is desired; installing the trim portion onto the base portion, wherein when the trim portion is installed on the base portion, the base portion is substantially concealed by the trim portion.

In some embodiments of the method, the base portion further comprises a structure adapted to grip a corresponding structure on the trim portion. In some embodiments of the method, the structure adapted to grip comprises a bead, and the corresponding structure on the trim portion comprises a groove. In some embodiments of the method, the structure adapted to grip comprises a ball, and the corresponding structure on the trim portion comprises a detent.

In some embodiments, the method further comprises applying an adhesive to at least one of the base portion and the trim portion, the adhesive effective to secure the trim portion to the base portion.

BRIEF DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numerals, and where:

DETAILED DESCRIPTION OF THE ILLUSTRATED EMBODIMENTS

Figure 1:
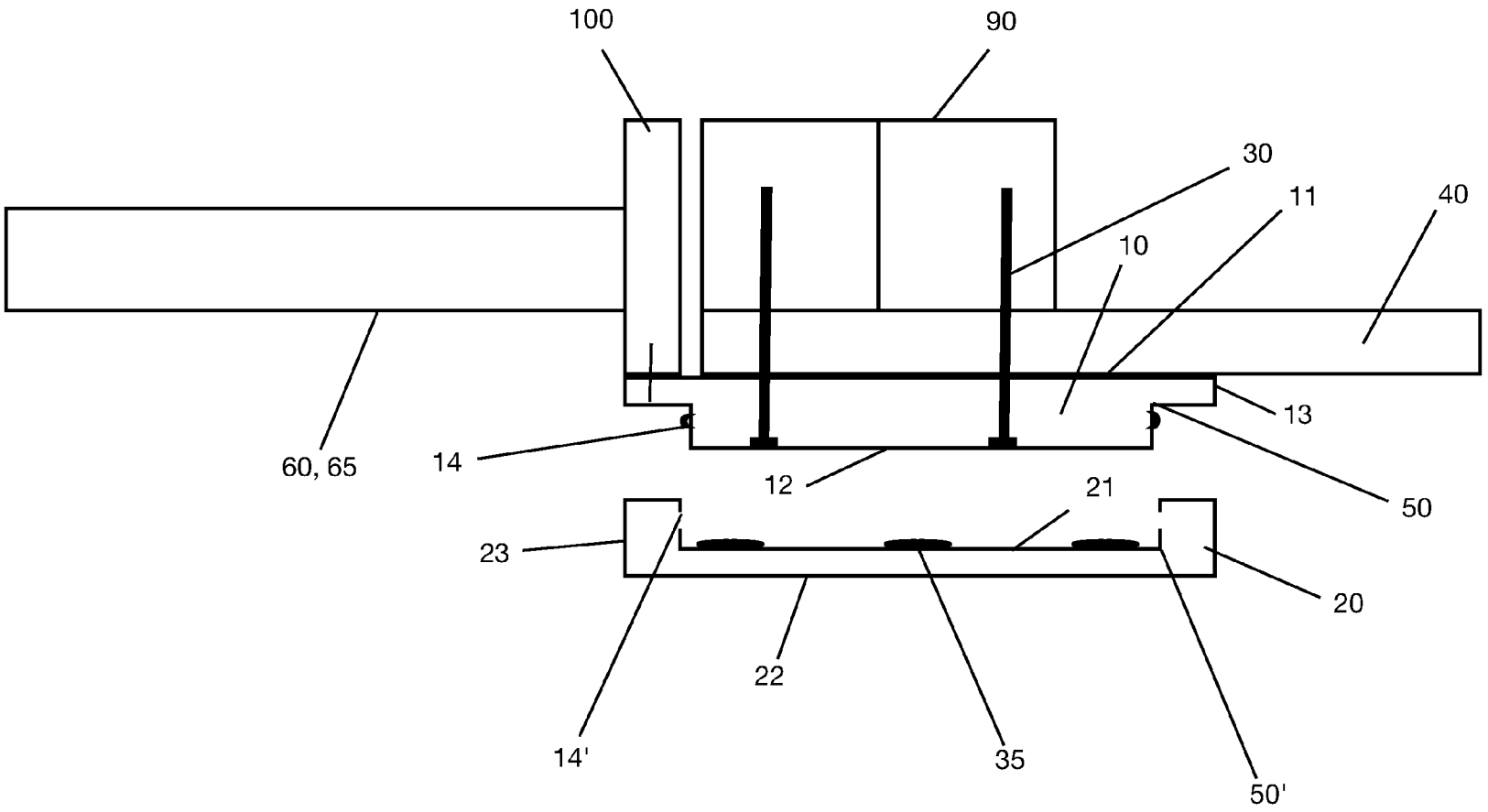
FIG. 1 depicts an embodiment of a trim molding system of the present invention.

The following discussion provides examples of embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed. Those of skill in the art will recognize that the described embodiment are examples of possible configurations of the invention, and are not intended to be limiting to the scope of the invention. Accordingly, the drawings and descriptions contained herein are to be regarded as illustrative of the invention as set forth in the accompanying claims.

These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

Unless the context dictates the contrary, all ranges set forth herein should be interpreted as being inclusive of their endpoints, and open-ended ranges should be interpreted to include commercially practical values. Similarly, all lists of values should be considered as inclusive of intermediate values unless the context indicates the contrary. In cases where dimensions or other measurements are provided in illustrations or the accompanying description, it is not intended that any such information is to be interpreted as limiting the scope of the invention.

The present invention provides a pre-fabricated trim system and methods for installing pre-finished trim moldings. The moldings described can be used in any number of instances in building construction. These include, for example, but are not limited to surrounds for windows and doors, baseboards, crown moldings, or anywhere that finishing moldings are used to provide an aesthetically pleasing finished look.

In some embodiments, the trim system comprises a molding base 10 and complementary pre-finished molding face 20. In general, the molding base can be secured to the location where the molding is to be installed using typical construction fasteners 30. In a preferred embodiment, the base has a back face 11 that is secured to the structure 40 where the molding is to be installed, and a front face 12 onto which a pre-finished molding face 20 can be positioned. In exemplary embodiments, the system can be installed to fit around an opening in a structure such as a doorway 60 or window 65.

Figure 2:
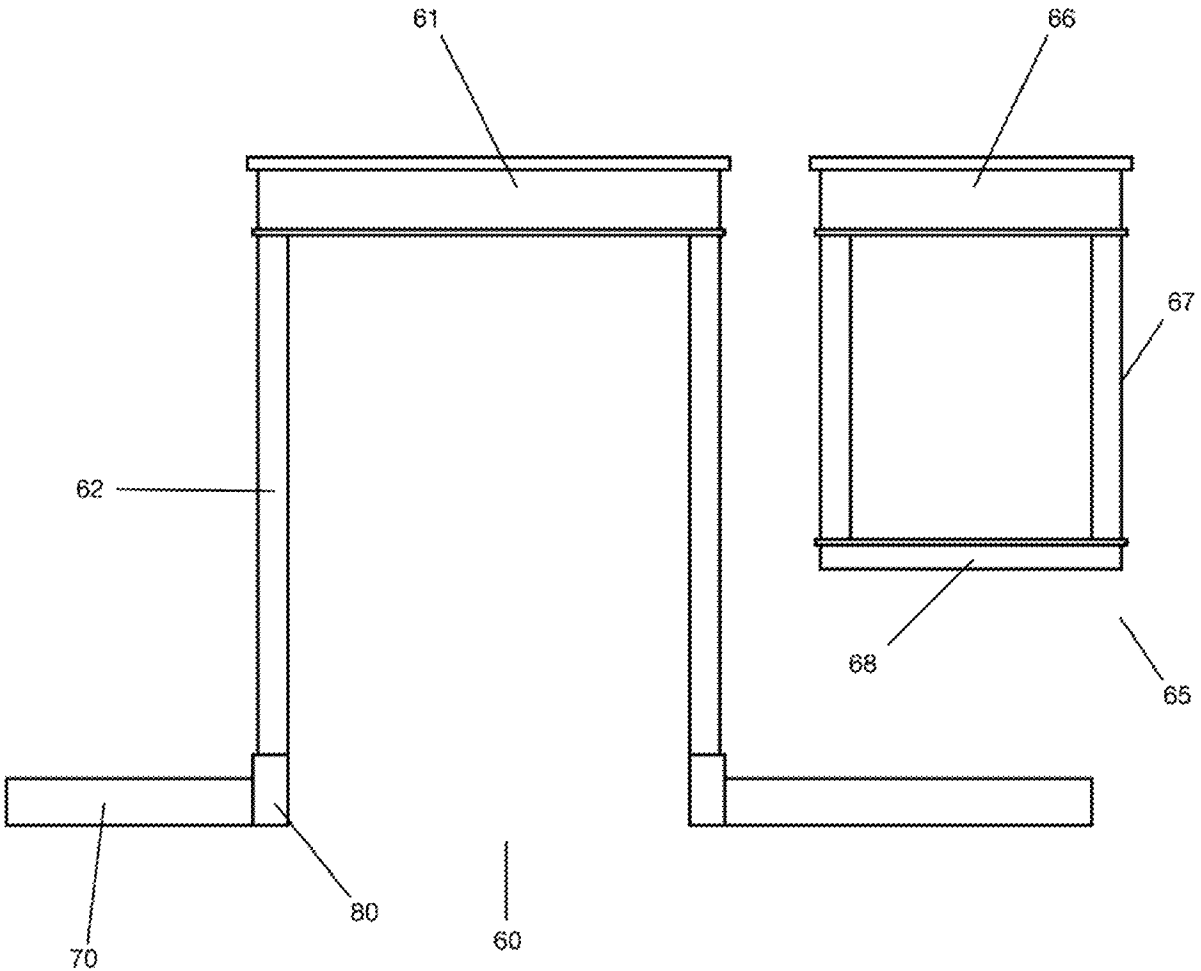
FIG. 2 depicts exemplary uses of embodiments of a trim molding system of the present invention.

As depicted in FIG. 2 the trim system can be employed to form commonly found structures in windows and doorways such as headers 61, 66, casings 62, 67, as well as other finishing trim features such as windowsills 68, baseboards 70 or the plinth blocks 80 found at the base of a doorway where the door jamb normally abuts a baseboard or other similar finishing trim material. A key advantage provided by the system is that in contrast to prior art designs, no fasteners are applied through the molding face and so the molding retains a smooth unblemished finish after installation.

The base further comprises side surfaces 13 that extend from the back to front surfaces of the base portion. In some embodiments these side surfaces are further modified to provide a base fitting surface 14 which engages a molding fitting surface 14', these two surfaces complementary to each other such that the molding fits to the base in a predetermined position. The complementary fitting surfaces provide for further securement of the molding base to the molding face.

The molding face 20 also comprises an inner surface 21, outer surface 22, and side surfaces 23. The molding fitting surface in some embodiments is substantially parallel to the outer surface of the molding and is configured to fit onto the front face of the base portion, as shown in FIG. 1. As described above, the molding face further comprises one or more interior fitting surfaces 14' that are configured to form a complimentary fit with complementary shaped fitting surfaces 14 of the base. In some cases the fitting surfaces can comprise a complementary tongue and groove arrangement well known in the art. In some embodiments, a fitting surface 14 might comprise a bias-loaded member, for example a ball bearing that is spring loaded into the base portion. A complementary detent could comprise a fitting surface 14' present in the molding face. Thus, when the molding face 20 is fitted onto the molding base 10, the bearing would be compressed and engage the detent, thus holding the molding in position on the base. It would be equally possible to reverse the arrangement such that a bearing was placed in the face and the base portion included the detent. Regardless of the precise arrangement, the specific shape and conformation of the complementary fitting surfaces is not considered to be limiting to the scope of the invention. It will be readily appreciated that for the most secure fit, the base portion and molding portion will be shaped such that they fit together in complementary fashion.

The back surface 11 of the molding base 10 (i.e., the surface that contacts the mounting surface) will generally extend the full length of the base. The base can further comprise notches 50 on at least one, and preferably both sides, the notches configured to receive a complementary notch 50' formed in the pre-finished molding, as is shown in FIG. 1. In some embodiments, a cross-section of the base and molding notches will generally be formed as right angles that complement each other, although it is possible to produce complimentary components with notches having cross-sectional profiles other than right angles.

In the illustrated embodiment then, the base portion when viewed in one cross-sectional aspect has a T-shaped profile. In turn, the pre-finished molding portion forms a complementary cross-section that fits the T-shape formed by the base. Those of skill in the art will readily appreciate that bevels, tongue and groove and other well-known shapes could be used to fit a molding to the molding base, depending on the particular configuration of one piece of molding with respect to another adjacent piece. In effect, the molding fits over the base in a cap-like fashion, such that the fasteners holding the base to the underlying surface will be hidden from view by the molding.

In some embodiments, the base and molding portions can comprise additional features to improve the precision and security of the fit between the base and molding. As shown in FIG. 1, the complementary fitting surfaces can comprise a gripping bead that runs substantially the length of the exterior side face of the base, and which fits into a corresponding cove, or groove, cut into the molding. During installation of the molding on the base, the molding can either be slid into place by aligning the groove and bead, or in some cases, depending on the material used to manufacture the components of the trim system, can be snapped into place by simply placing the molding onto the base and applying sufficient force to flex the outer edges of the molding sufficiently to allow the groove to ride over the gripping bead.

A bead and cove can be formed such that the molding will be aligned with the base when it is clipped or slid into place. A bead and cove arrangement provides additional security such that the molding will not be able to be pulled directly away from the base. So, for example, should the adhesive between the molding base and the molding face degrade over time, it is unlikely that the molding will fall away from the base and the gripping bead will tend to maintain the molding in position. In some embodiments, it may be possible to simply clip the molding onto the base without the need for any additional fastening means, such as adhesives, in order to maintain the configuration of the finished trim. As will be appreciated the location of the gripping bead and cove can be reversed and accomplish the same result, i.e. the bead may be formed on the molding, and the cove or groove cut into the base. This type of arrangement would also allow for one to make changes to the style of the trim facing, without having to completely reinstall the entire trim system. It would therefore be possible to readily swap out the finished facing portion and re-apply a new trim facing to the underlying base portion.

In still other embodiments, and as described in the context of complementary fitting surfaces, the bead of a bead and cove arrangement could comprise one or more ball bearings or other similar structure mounted on a spring-loaded mechanism. Rather than a groove or cove in the molding, there could be included a detent positioned such that when the molding is slid into place, eventually the ball bearing and detent will be aligned, and the bearing will be pushed by the spring (or other bias member) into the detent. An installer will be instantly aware the molding is positioned correctly when the ball clicks into place in the corresponding detent.

As also shown in FIG. 1, for additional security of fit, there may be provided adhesive material 35 that operates to bond the molding to the base. Adhesive may be provided as part of the manufactured components so that they are ready to be simply connected together, or, a worker can apply adhesive during the installation process. A variety of adhesives such as tapes and glues are well known in the art and can be readily adapted for use with the present trim molding system. In some embodiments, the adhesive may be applied at a number of spots along either the base or the face portion. FIG. 1 shows, for example, 3 applications of adhesive roughly equally spaced across the inner face 21 of the face portion 20. In some cases it may be preferable to apply adhesive across the entire inner face of the facing portion, or alternatively at spots on the base or along substantially the entire complementary surface of the base that will eventually contact the face portion.

The base portion can be easily installed in virtually any location. For example, the molding base can be secured to the wall surrounding a door or window opening, as depicted in FIG. 1. The base can be secured using nails, screws or other means of fastening. As shown in the accompanying FIG. 1, the base can be secured to underlying structural components such as wall studs 90 using fasteners, for example nails or screws, that extends through the overlying drywall material. Attaching to the underlying stud provides a substantially more secure attachment of the molding base to the installation location than would be possible if the base were simply secured to the surface by gluing or some other less temporary method. As also depicted in FIG. 1 the base portion may overlap with a portion of the structure of a window or doorway installation 100, such as s door jamb, or other comparable structure such as the outer framing of a window installation.

Securing the molding to the base can be accomplished in a number of ways. For example, in some embodiments, and as shown in FIG. 1, an adhesive can be placed into the inner surface of the molding, or obviously, on the outer surface of the base. The molding can then be positioned on the base, and the glue once cured will provide secure attachment. One advantage of the present system and method of installation is that there is no requirement for screws, nails or other similar fasteners to secure the molding face to the base portion. This will improve the look of the finished product as there will be no fasteners marks or holes that otherwise would have to be filled, and or painted, in order to make the finished product aesthetically pleasing.

The molding can be manufactured to provide a structure that substantially complements the shape of the base, and in particular the shape of the notches cut into the side surfaces of the base portion. In addition, as the outer and side surfaces of molding portion are finished, the base portion will be effectively invisible to the eye when the trim system is completely installed. Thus, the present invention provide a single molding piece that has side and outer surfaces that are finished, thus obviating the need to any additional finishing pieces to complete the finished trim installation. The components of the system can be made from a variety of materials, including wood, metal, plastics, PVC or other materials commonly used in construction.

The present system provides an additional advantage in that the exterior finished appearance can be widely varied, without the need to modify the basic principles upon which the system operates. For example, it is possible to change the ornamentality of the molding portion outer surface (the part that will be visible after installation), while using the same base portion configuration. Thus, and is shown in FIG. 2, it is possible to form a finished molding product having a simple case, plinth and baseboard, with more ornate headers and window sills. Virtually any combination of molding pieces becomes useful in producing a finished molding product using what is effectively a universally adaptable installation system and method. And, as discussed previously, it allows for a change in appearance by simply swapping out the molding face, without having to remove or re-install the base portion.

It will be recognized that the specific materials used in constructing the various components of the system described herein, are not considered to be limiting to the scope of the invention. Those of skill in the art will readily recognize and be able to select materials and components that will accomplish the objectives of the invention without requiring any inventive skill.

It should also be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

I claim:

1. A finishing trim system, comprising:

a base portion, comprising an inner surface, outer surface and side surfaces, the side surfaces extending perpendicular to the inner surface and the outer surface, wherein the inner surface of the base portion is configured to be secured to a building structure;

a trim portion, comprising an inner surface, outer surface, inner side surfaces and outer side surfaces, wherein the trim portion outer surface and outer side surfaces comprise a substantially finished ornamental configuration;

wherein the base portion outer surface and side surfaces are configured to receive the trim portion inner surface and inner side surfaces respectively, installable on the base portion;

wherein when the trim portion is installed on the base portion, the base portion is substantially concealed by the trim portion;

wherein the base portion further comprises a structure adapted to grip a corresponding structure on the trim portion;

wherein the structure adapted to grip comprises a bead extending from one of the base portion side surfaces, and the trim portion comprises a groove in one of the trim portion side surfaces for receiving the bead;

wherein the structure adapted to grip comprises a ball extending from one of the base portion side surfaces, and the trim portion comprises a detent in one of the trim portion side surfaces for receiving the ball; and wherein the ball and detent are configured to maintain the base portion and trim portion in a fixed positional relationship.

2. The system of claim 1, wherein at least one of the base portion and trim portion comprises an adhesive configured to secure the trim portion to the base portion.

3. A method of installing a finishing trim, the method comprising:

providing a base portion, comprising an inner surface, outer surface and side surfaces, wherein the inner surface of the base portion is configured to be secured to a building structure;

providing a trim portion, comprising an inner surface, outer surface, inner side surfaces and outer side surfaces, wherein the outer surface and outer side surfaces comprise a substantially finished ornamental configuration;

wherein the base portion outer surface and side surfaces are configured to receive the trim portion inner surface and inner side surfaces respectively, installable on the base portion;

securing the base portion to a location on a structure where a finishing trim is desired;

installing the trim portion onto the base portion, wherein when the trim portion is installed on the base portion, the base portion is substantially concealed by the trim portion;

wherein the base portion further comprises a structure adapted to grip a corresponding structure on the trim portion;

wherein the structure adapted to grip comprises a bead, and the corresponding structure on the trim portion comprises a groove;

wherein the structure adapted to grip comprises a ball, and the corresponding structure on the trim portion comprises a detent; and wherein the ball and detent are configured to maintain the base portion and trim portion in a fixed positional relationship.

4. The method of claim 3, further comprising applying an adhesive to at least one of the base portion and the trim portion, the adhesive configured to secure the trim portion to the base portion.

* * * * *